US009334655B2

(12) United States Patent
Polumbus et al.

(10) Patent No.: US 9,334,655 B2
(45) Date of Patent: May 10, 2016

(54) VENTILATED ROOF SYSTEM WITH RIDGE VENT

(71) Applicant: MARCO INDUSTRIES, INC., Tulsa, OK (US)

(72) Inventors: Mark D. Polumbus, Broken Arrow, OK (US); Daniel Housley, Broken Arrow, OK (US); Robert P. Harris, Tulsa, OK (US)

(73) Assignee: MARCO INDUSTRIES, INC., Tulsa, OK (US)

( * ) Notice: Subject to any disclaimer, the term of this patent is extended or adjusted under 35 U.S.C. 154(b) by 0 days.

(21) Appl. No.: 13/633,023

(22) Filed: Oct. 1, 2012

(65) Prior Publication Data

US 2013/0036686 A1 Feb. 14, 2013

Related U.S. Application Data

(63) Continuation of application No. 13/245,383, filed on Sep. 26, 2011, now Pat. No. 8,276,331, which is a continuation of application No. 12/569,252, filed on Sep. 29, 2009, now Pat. No. 8,024,897, which is a continuation of application No. 10/833,814, filed on Apr. 27, 2004, now Pat. No. 7,594,363.

(51) Int. Cl.
*E04D 13/17* (2006.01)

(52) U.S. Cl.
CPC ..... *E04D 13/174* (2013.01)

(58) Field of Classification Search
CPC . E04D 13/174; E04D 13/176; E04D 13/1656; E04D 13/178; F24F 7/02; Y10T 29/49623
USPC ..... 52/198, 199, 359, 302.1; 454/365, 366
See application file for complete search history.

(56) References Cited

U.S. PATENT DOCUMENTS

| | | | |
|---|---|---|---|
| 429,937 | A | 6/1890 | Mitchell |
| 2,318,820 | A | 5/1943 | Voigt et al. |
| 3,884,009 | A | 5/1975 | Frohlich et al. |
| 3,949,657 | A | 4/1976 | Sells |
| 4,024,685 | A | 5/1977 | Aarons |
| 4,189,886 | A | 2/1980 | Frohlich et al. |
| 4,280,399 | A | 7/1981 | Cunning |
| 4,325,290 | A | 4/1982 | Wolfert |
| 4,558,637 | A | 12/1985 | Mason |
| 4,570,396 | A | 2/1986 | Struben |
| 4,598,505 | A | 7/1986 | McGown |
| 4,754,589 | A | 7/1988 | Leth |
| 4,843,953 | A | 7/1989 | Sells |
| 4,876,950 | A | 10/1989 | Rudeen |
| 4,924,761 | A | 5/1990 | MacLeod et al. |
| 4,957,037 | A | 9/1990 | Tubbesing et al. |
| 4,995,308 | A | 2/1991 | Waggoner |

(Continued)

*Primary Examiner* — Rodney Mintz
*Assistant Examiner* — Daniel Kenny
(74) *Attorney, Agent, or Firm* — Dorsey & Whitney LLP

(57) ABSTRACT

A roofing system in a building structure having a ridge vent includes strips of composite material having a base material adapted to form a hermetic seal with the top surface of a roofing section and recesses in a top surface in which an air permeable material can be positioned. A strip is applied to roof sections adjacent to each side of a ridge vent so that a ridge cap can overlay the strips in spaced relation from the underlying roof sections and be sealingly secured to the roof sections. The strip material establishes a barrier between the ridge cap and the roof sections through which air can pass, but through which the passage of rain and insects is inhibited.

20 Claims, 5 Drawing Sheets

(56) References Cited

U.S. PATENT DOCUMENTS

| | | | | |
|---|---|---|---|---|
| 5,002,816 | A | | 3/1991 | Hofmann et al. |
| 5,009,149 | A | | 4/1991 | MacLeod et al. |
| 5,022,203 | A | | 6/1991 | Boyd |
| 5,060,431 | A | | 10/1991 | MacLeod et al. |
| 5,092,225 | A | | 3/1992 | Sells |
| 5,095,810 | A | | 3/1992 | Robinson |
| 5,122,095 | A | | 6/1992 | Wolfert |
| 5,167,579 | A | | 12/1992 | Rotter |
| 5,174,076 | A | | 12/1992 | Schiedegger et al. |
| 5,288,269 | A | | 2/1994 | Hansen |
| 5,304,095 | A | | 4/1994 | Morris |
| 5,326,318 | A | | 7/1994 | Rotter |
| 5,328,407 | A | | 7/1994 | Sells |
| 5,331,783 | A | | 7/1994 | Kasner et al. |
| 5,332,393 | A | | 7/1994 | Godl |
| 5,352,154 | A | | 10/1994 | Rotter et al. |
| 5,353,154 | A | | 10/1994 | Lutz et al. |
| 5,425,672 | A | | 6/1995 | Rotter |
| 5,427,571 | A | | 6/1995 | Sells |
| 5,439,417 | A | | 8/1995 | Sells |
| 5,458,538 | A | | 10/1995 | MacLeod et al. |
| 5,473,847 | A | | 12/1995 | Crookston |
| 5,542,882 | A | | 8/1996 | Sells |
| 5,561,953 | A | * | 10/1996 | Rotter ..... 52/198 |
| 5,603,657 | A | | 2/1997 | Sells |
| 5,816,014 | A | | 10/1998 | Tzeng et al. |
| 5,826,383 | A | * | 10/1998 | Garrison ..... 52/198 |
| 5,921,863 | A | | 7/1999 | Sells |
| 6,079,166 | A | * | 6/2000 | Mason et al. ..... 52/198 |
| 6,125,602 | A | | 10/2000 | Freiborg et al. |
| 6,298,613 | B1 | | 10/2001 | Coulton et al. |
| 6,308,472 | B1 | | 10/2001 | Coulton et al. |
| 6,418,678 | B2 | | 7/2002 | Rotter |
| 6,491,581 | B1 | | 12/2002 | Mankowski |
| 6,662,510 | B2 | | 12/2003 | Rotter |
| 6,773,342 | B2 | * | 8/2004 | Rotter ..... 454/365 |
| 6,944,997 | B2 | * | 9/2005 | Verkamp ..... 52/309.4 |
| 7,594,363 | B2 | * | 9/2009 | Polumbus et al. ..... 52/199 |
| 8,024,897 | B2 | | 9/2011 | Polumbus et al. |
| 8,024,987 | B2 | * | 9/2011 | Yamaguchi et al. ..... 74/89.23 |
| 8,276,331 | B2 | * | 10/2012 | Polumbus et al. ..... 52/199 |
| 8,302,352 | B2 | * | 11/2012 | Bahn ..... 52/199 |
| 2002/0032000 | A1 | | 3/2002 | Lawless, III et al. |
| 2003/0022618 | A1 | | 1/2003 | Miller |
| 2003/0051419 | A1 | | 3/2003 | Suzuki |
| 2003/0077999 | A1 | | 4/2003 | Mankowski |

* cited by examiner

VENTILATED ROOF SYSTEM WITH RIDGE VENT

CROSS-REFERENCE TO RELATED APPLICATION

The present application is a continuation of U.S. patent application Ser. No. 13/245,383 filed on Sep. 26, 2011, now U.S. Pat. No. 8,276,331, entitled "Ventilated Roof System With Ridge Vent", which is a continuation of U.S. patent application Ser. No. 12/569,252 filed on Sep. 29, 2009, now U.S. Pat. No. 8,024,897, entitled "Ventilated Roof System With Ridge Vent", which is a continuation of U.S. patent application Ser. No. 10/833,814, now U.S. Pat. No. 7,594,363, filed on Apr. 27, 2004, entitled "Ventilated Roof System With Ridge Vent", all of which are hereby incorporated by reference as though fully set forth herein.

BACKGROUND OF THE INVENTION

1. Field of the Invention

The present invention relates generally to ventilated roof systems for building structures, and more particularly to a roof system having a ridge vent and an air permeable sealant system.

2. Description of the Relevant Art

It is common to ventilate roofs of building structures to remove stagnant or hot air, with such ventilating systems sometimes including vents in the gables of the building structure, along the soffits or along the ridge or apex of the roof. The vents, of course, are provided to permit the ingress and egress of air and when the vent is along the ridge, the air naturally egresses through the vent from beneath the roof by convection. Ridge vents are typically combined with gable or soffit vents through which air can flow into the space below the roof to encourage a continuous flow of air from the ambient environment, through the space beneath the roof and back to the ambient environment through the ridge vent.

One problem with vents which simply consist of openings in a building structure through which air can readily pass, is that insects, rain or other undesirable elements can also pass through the openings.

Accordingly, it has been discovered with ridge vents that the use of an air permeable material such as a matting of randomly oriented interconnected or reticulated synthetic fibers inhibits the passage of insects or rain while permitting the flow of air. Accordingly, such material provides a desirable air permeable sealant material for use with ridge vents. An example of such a reticulated material in ridge vents is found in U.S. Pat. No. 5,561,953, and an example of the reticulated material for use in a ridge vent is disclosed in U.S. Pat. No. 5,167,579. Still another venting system for ridge vents is disclosed in U.S. Pat. No. 5,353,154, but the system disclosed therein is useful only on relatively flat roofing. The invention disclosed in U.S. Pat. No. 5,561,953 was developed to overcome the shortcomings of the flat roof system and provides a system wherein the reticulated material is grooved on a bottom surface to conform with the transverse contour of an underlying roof such as might be found on tile roofs, corrugated aluminum roofs, metal roofs having upstanding projections and the like.

A problem with a sealant ridge vent system of the type disclosed in U.S. Pat. No. 5,561,953 or 5,352,154 resides in the fact that the reticulated material rests directly on the underlying roof surface and since the reticulated material is a very open material that does not present a continuous flat, smooth surface to the underlying roof, it does not provide a desirable sealable surface between the ridge vent system and the underlying roof.

Accordingly, it would be desirable that a ridge vent system include a sealant strip that was not only air permeable so that the building structure was adequately ventilated, but also a system whereby the sealant strip could be positively sealed to the underlying roof to prevent the ingress of rain, insects or the like between the sealant strip and the roof.

It is to overcome the shortcomings in prior art systems and to provide a new and improved system for sealing a ridge roof vent that the present invention has been developed.

SUMMARY OF THE INVENTION

The present invention concerns an improved air permeable sealant system for a ridge vent found in building structures wherein the sealant strip can be positively and hermetically sealed to the underlying roof. This is accomplished while permitting the egress of air from the underlying building structure and inhibiting the ingress of insects, rain and other undesirable elements.

Typical ridge roof vents are provided on roof structures wherein a pair of roof sections are angled relative to each other so as to define a roof of generally inverted v-shaped transverse cross-section. At the apex of the roof a slot is provided or formed that defines a gap between the roof sections and through which air can be vented from beneath the roof system. A ridge cap, also typically of inverted v-shaped cross-section, overlies the slot to prevent rain or other undesirable elements from passing downwardly through the slot with the ridge cap being spaced from the underlying roof sections to permit the egress of air from the underlying building structure. The strip of the present invention is provided for placement between the ridge cap and the underlying roof sections in a manner to be sealed to the underlying roof sections and permit the egress of air from the building structure, but inhibit the ingress of moisture, insects, or the like.

The strip includes two integrated or composite parts, with one part being of denser construction than the other. The one more dense part has a relatively flat smooth surface which can be engaged and hermetically bonded to an associated roof section adjacent to the slot in the roof structure to establish a water and bug-proof barrier between the strip and the underlying roof section. The opposite or upper surface of the strip is adapted to receive the second, less-dense material which is attached to the first material. The second less-dense material has an upper surface in engagement with the undersurface of the ridge cap. In a preferred embodiment, the first material has recesses in its upper surface in which the second material is positioned and bridge sections between the recesses establishing locations where the ridge cap can be connected to the underlying roof section by passing fasteners through the ridge cap, the bridge section, and into the underlying roof section.

The strip is useful on substantially flat roofs such as might have aggregate shingles or the like or can be slotted or notched in its bottom surface to accommodate ridges or other projections that might be found on metal roofs, tile roofs, corrugated roofs, or the like.

Other aspects, features and details of the present invention can be more completely understood by reference to the following detailed description of a preferred embodiment, taken in conjunction with the drawings and the appended claims.

DESCRIPTION OF THE PREFERRED EMBODIMENT

Figure 1:
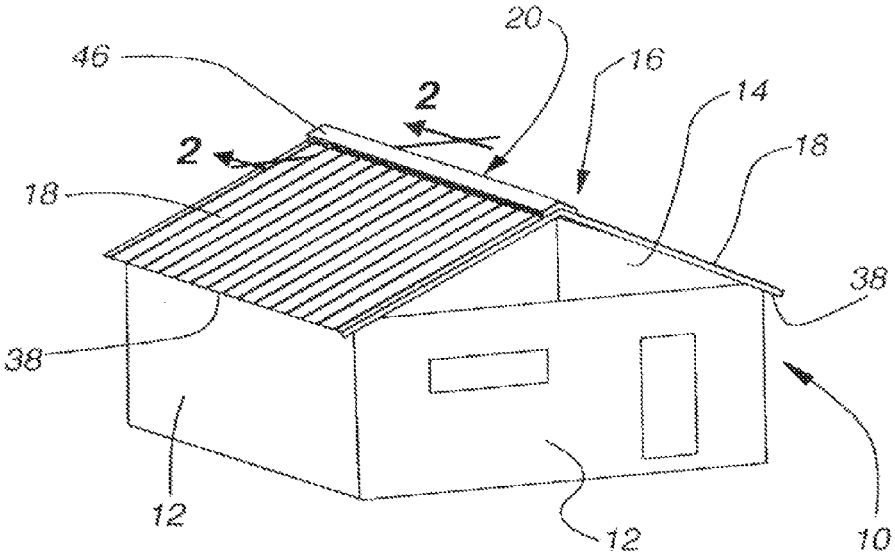
FIG. 1 is an isometric view of a building structure having a roof with a ridge vent and the sealant system of the present invention.
Figure 2:
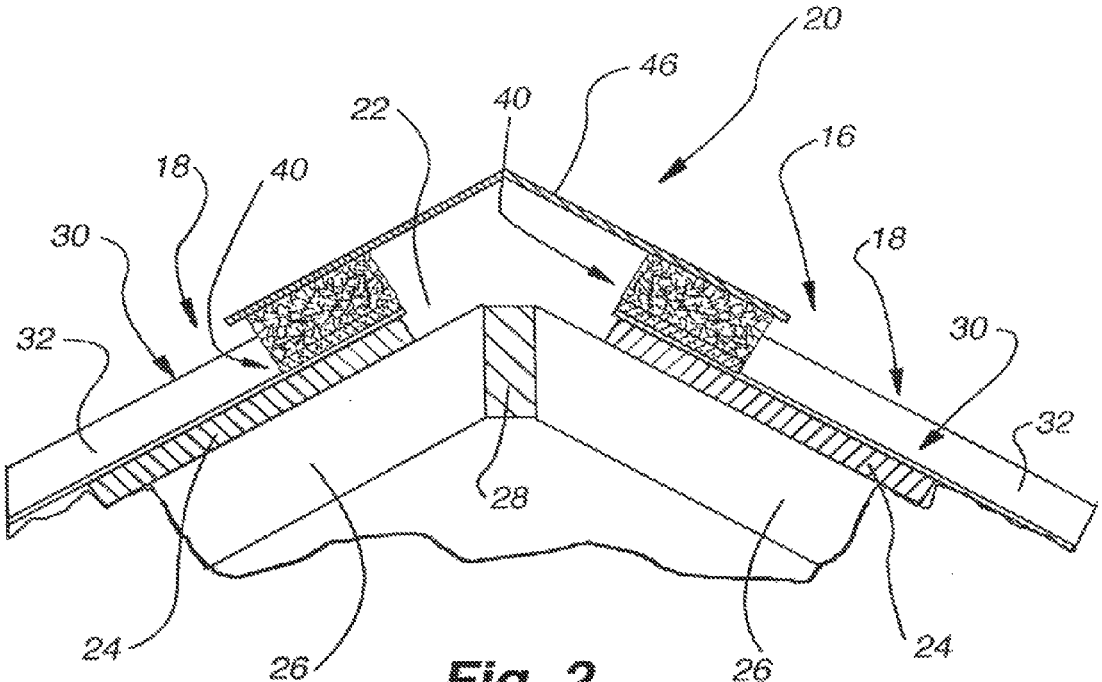
FIG. 2 is an enlarged fragmentary section taken along line 2-2 of FIG. 1.
Figure 3:
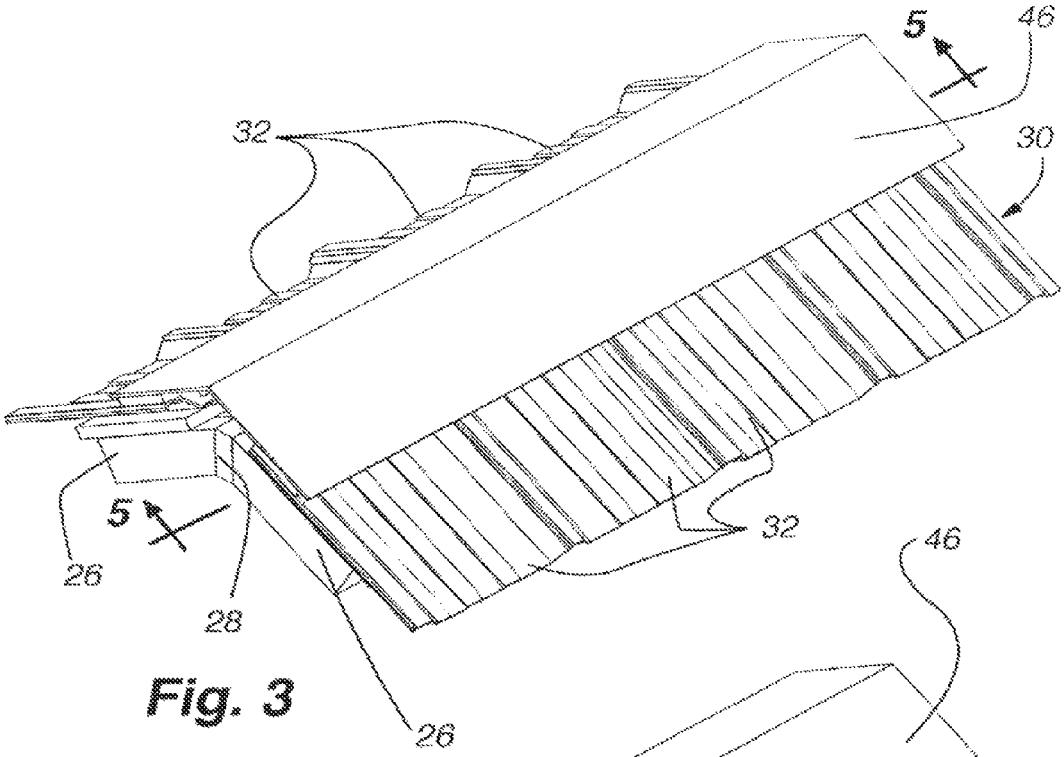
FIG. 3 is a fragmentary isometric showing the ridge of the building structure of FIG. 1 with the sealant system of the present invention incorporated therein.
Figure 4:
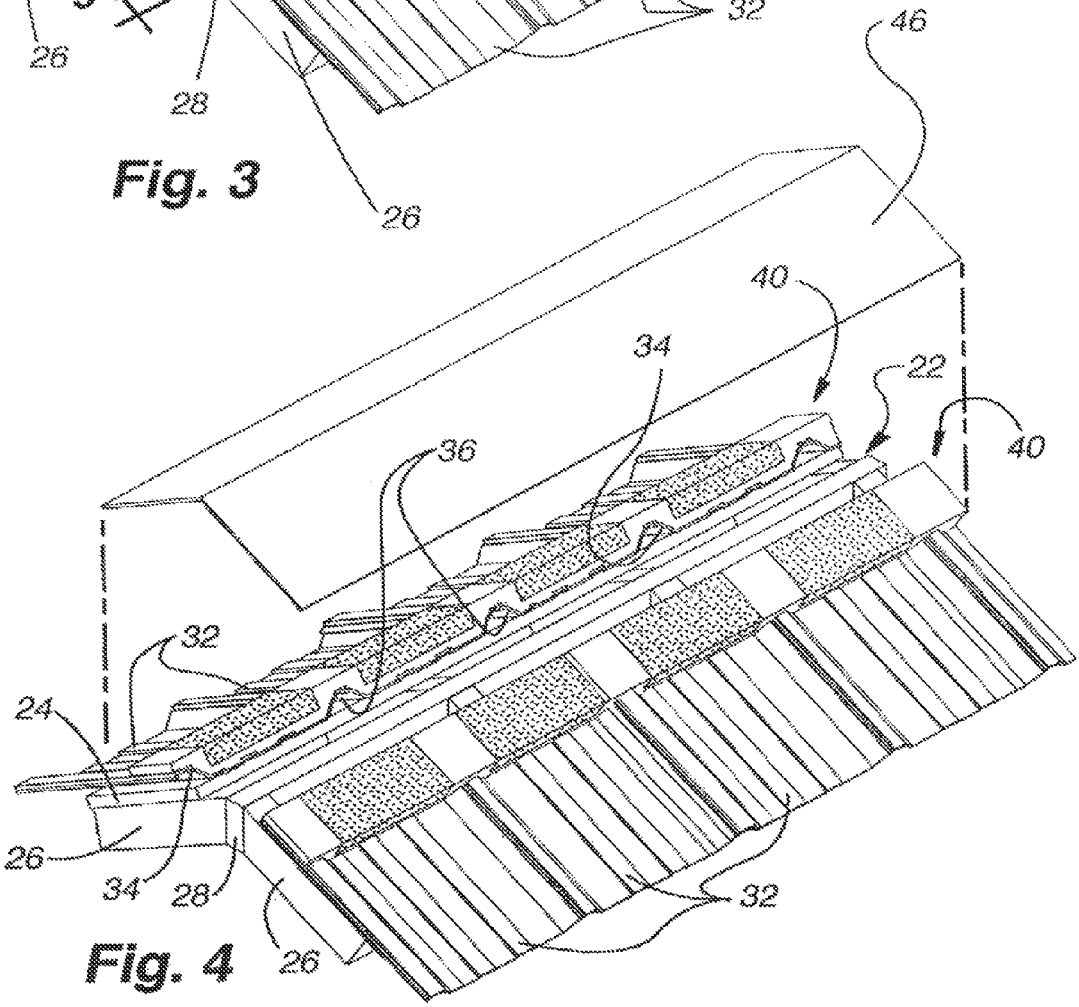
FIG. 4 is a fragmentary isometric similar to FIG. 3 with the ridge cap exploded.

A building structure 10 having a roof system incorporating the ridge vent of the present invention is shown in FIG. 1 to have sidewalls 12, gables 14 at opposite ends (only one being shown), and an inverted v-shaped roof structure 16 having a pair of roof sections 18 intersecting along an apex or ridge 20 of the roof. A conventional slot or ridge opening 22, as possibly best seen in FIG. 2, is established along the ridge of the roof system with the slot being established between layers of decking material 24 associated with each roof section 18 with the decking being supported on rafters 26 which are in turn interconnected with a longitudinal beam 28 as is common in the building trade. The decking 24 is overlaid with an outer covering 30 of roofing material which in the disclosed embodiment is composed of interconnected, elongated strips or channels 32 of metal or the like of generally u-shaped cross-section even though the invention would be applicable to flat outer coverings or outer coverings of corrugated materials, tile, or the like.

Figure 5:
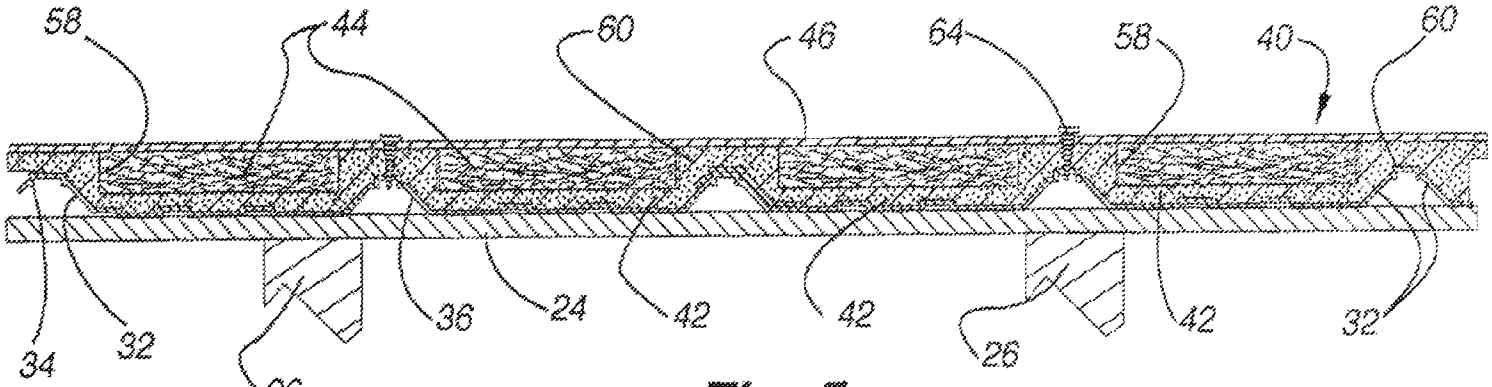
FIG. 5 is an enlarged fragmentary section taken along line 5-5 of FIG. 3.

As probably best appreciated by reference to FIG. 5, while the channels 32 which extend perpendicularly to the ridge 20 of the roof system can be formed in many different ways, the channels used to facilitate a description of the present invention are elongated, having complementary opposite longitudinal edges so that the edge of one panel can overlap and be releasably connected to the opposite edge of the next adjacent channel. At the interconnection 34 of adjacent channels and at one or more spaced locations 36 therebetween there are upstanding ribs or projections of generally trapezoidal transverse cross-section extending parallel to the longitudinal edges of each channel 32. Such channel formed roofing materials are common in the trade and are illustrated for exemplary purposes only. It will be appreciated by reference to FIG. 5 that when adjacent channel members 32 are interconnected along adjacent edges, with one edge overlapping the opposite edge of an adjacent channel member, the entire outer covering 30 for the roof decking is established with upstanding ribs 34 and 36 extending perpendicularly to the ridge 20 and the lower edge 38 of the associated roof section 18.

The upper ends of the channel members 32 forming the roof covering 30 of one roof section 18 are spaced from the upper ends of the channel members on an adjacent roof section similarly to the spacing of the upper edges of the decking 24 for each roof section so that the opening or slot 22 is defined along the ridge permitting the egress of air from beneath the roof structure through the opening.

Sealant strips 40 in accordance with the present invention are secured to the top surface of each roof section 18 adjacent to and along each side of the opening 22. The securement is in any suitable manner but preferably with an adhesive so as to establish a fluid seal or barrier between the strip and the underlying roof section.

The sealant strip 40 as best appreciated by reference to FIGS. 5-9, is a composite strip of two aggregated or interconnected materials with one material 42 forming the base of the strip which is connected to the underlying roof section 18, and the other material 44 an overlying material seated on the top of the base and in a position to engage a ridge cap 46. The base material 42 could be numerous materials, but in accordance with the present invention, the base material is preferably a flexible material that is also air and liquid impermeable, with an example being a cross-link polyethylene foam of two pound density. The base material has a lower surface 48 that is adapted to engage the underlying roof section 18 with this surface being formed and contoured to mate with the cross-section of the covering 30 of the associated roof section. In the illustrated embodiment, the lower surface 48 is smooth but provided with transverse channels 50 having a trapezoidal cross-sectional configuration complementary to that of the ridges 34 and 36 in the interconnected channel members 32 which form the covering 30. In this manner, when the strip 40 is laid transversely to the length of the channel members and parallel to the slot 22 in the ridge of the roof structure, the strip is in continuous engagement with the underlying channel members of the covering 30. The base material 42 has a smooth bottom surface such that the strip can be sealed to the underlying channel members to prevent the passage of fluid, insects and the like across the interconnection of the strip with the channels.

Figure 9:
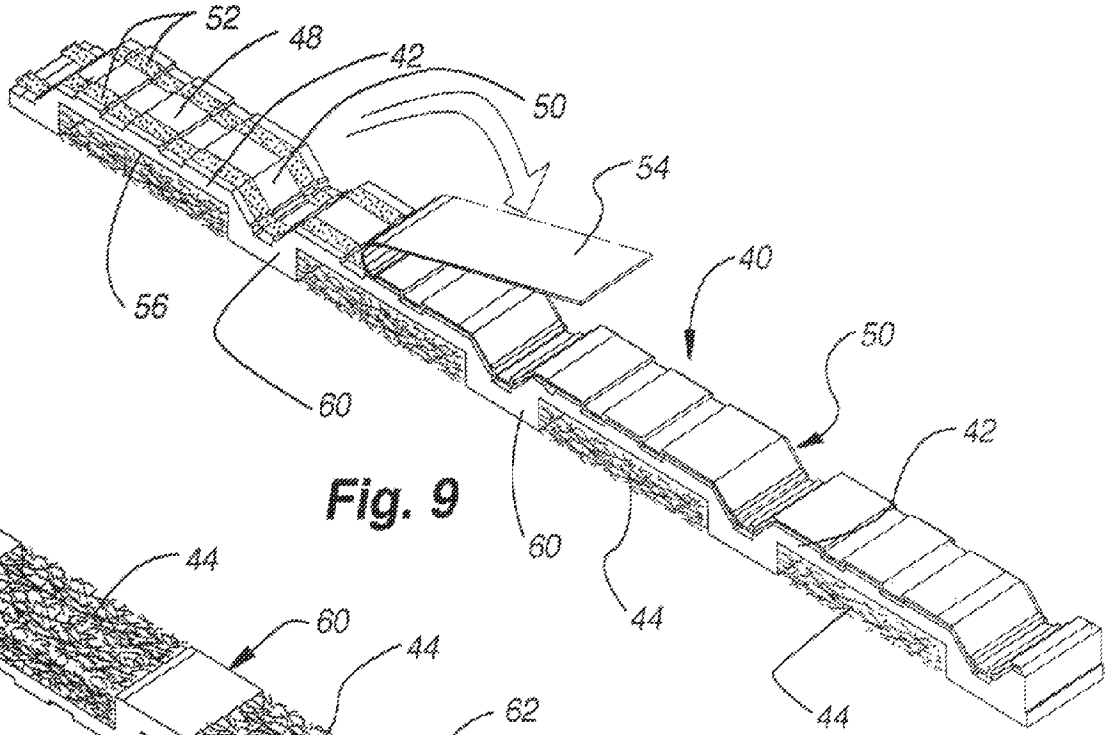
FIG. 9 is an isometric similar to FIG. 7 looking at the bottom of the strip and the removal of a tear-away paper strip overlying adhesive on the bottom surface.
Figure 8:
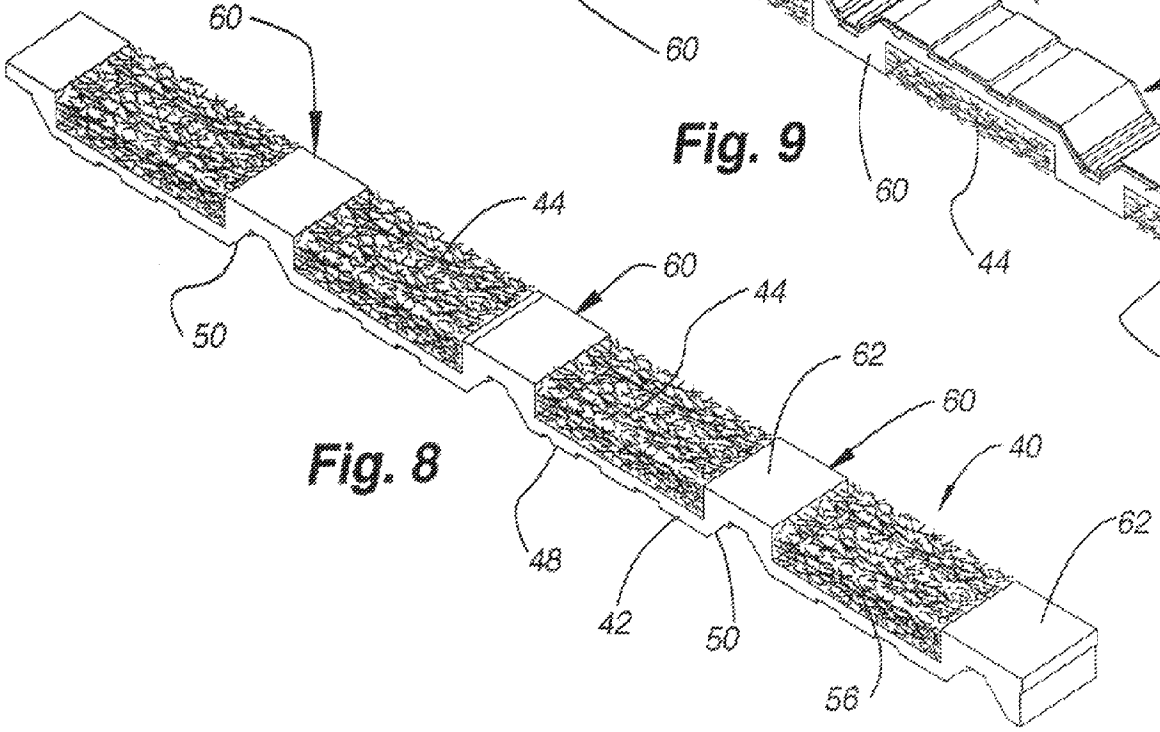
FIG. 8 is an isometric of the sealant strip used in the roof system of the present invention looking downwardly on the top of the strip.

In the preferred embodiment of the invention, the sealing is established with a pair of longitudinally extending strips 52 of adhesive, as seen in FIG. 9, which are spaced from each other and covered with a tear-away strip 54 of paper which facilitates shipping of the material and easy installation.

Figure 6:
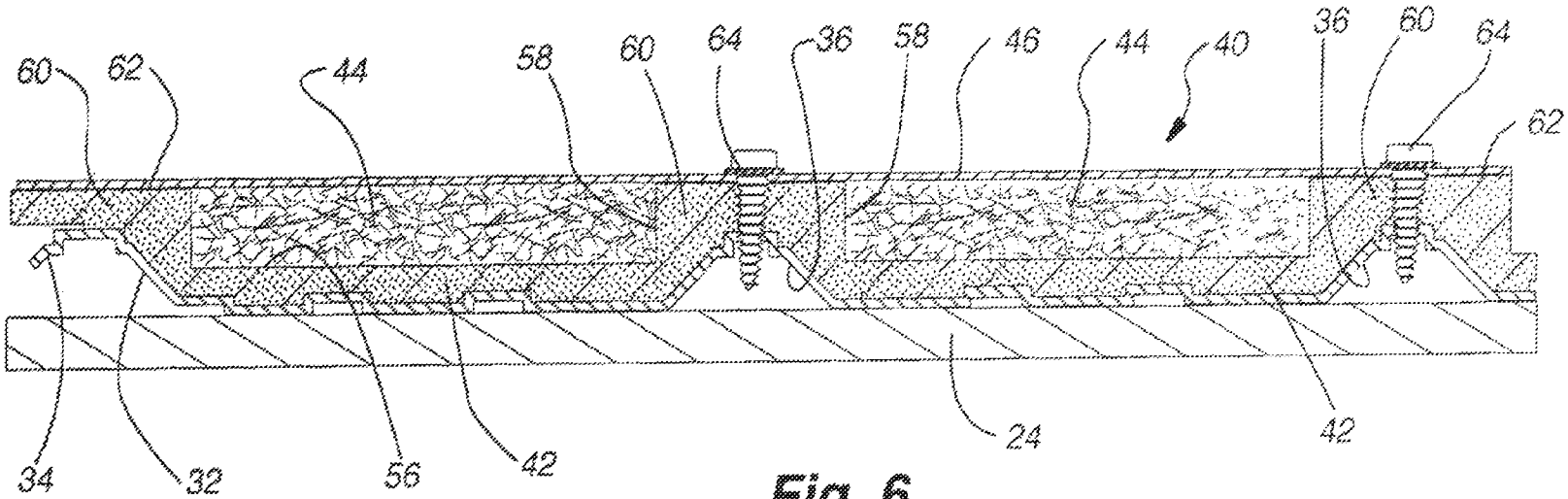
FIG. 6 is a further enlarged fragmentary section similar to FIG. 5.
Figure 7:
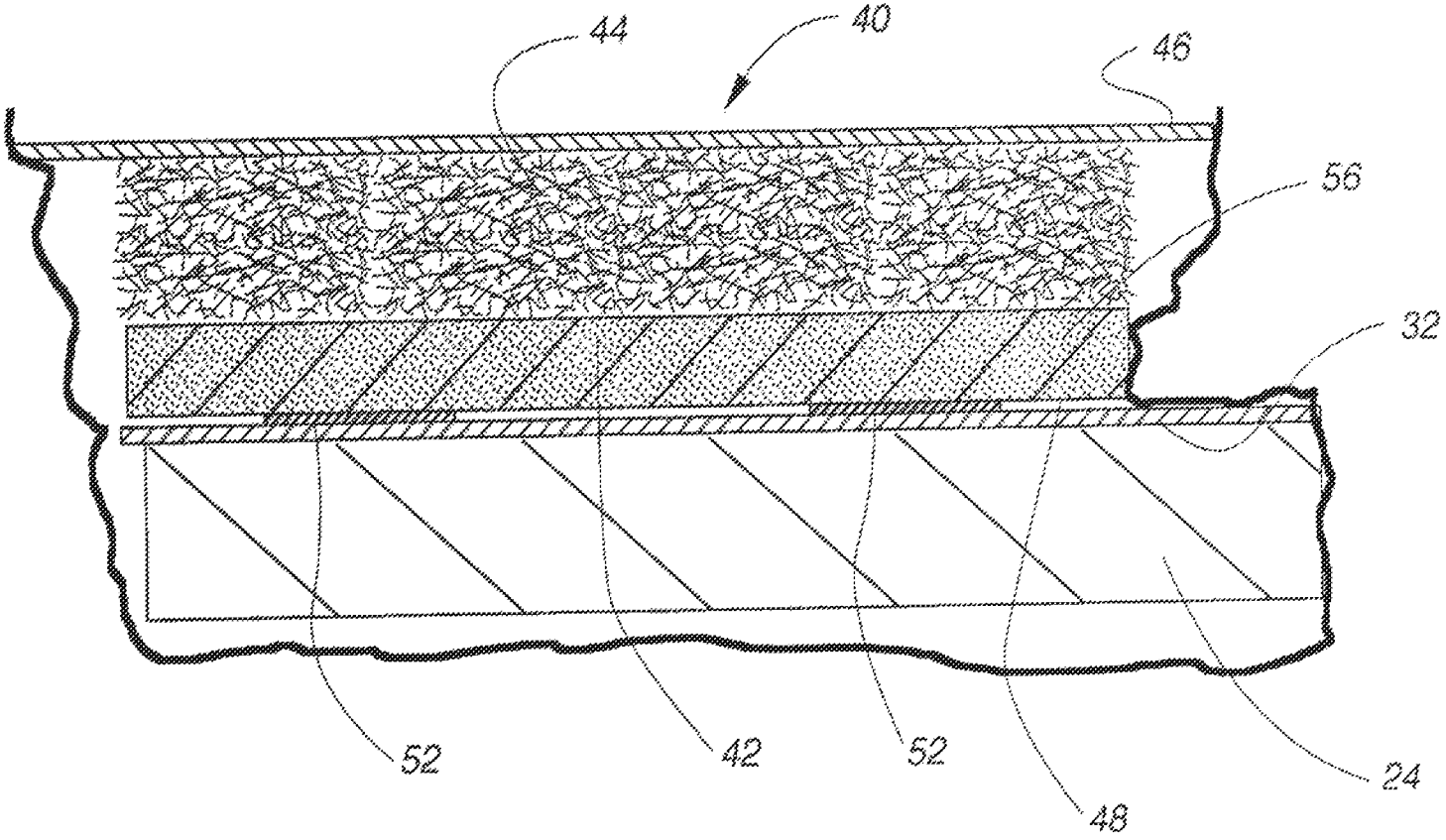
FIG. 7 is a still further enlarged fragmentary section similar to FIGS. 5 and 6.

The upper surface 56 of the base material as best seen in FIGS. 5-7, is provided with longitudinally spaced notches or recesses 58 of rectangular transverse cross-section which are spaced from each other by bridge sections 60 of the base material. The bridge sections of the base material have flat, continuous upper surfaces 62 for engagement with the ridge cap 46. The other composite material 44 used in the sealant strip has a lower concentration of matter so as to be air permeable and is positioned in the recesses 58 in the top surface of the base material so as to permit the free flow of air therethrough, but inhibit the passage of rain, insects, or the like. The air permeable material could be any suitable material, but a reticulated material has been found desirable that may be described as a strong, durable, modified polyester, non-woven, non-wicking, fiber-based matting of the type described in the aforementioned U.S. Pat. No. 5,167,579, the disclosure of which is hereby incorporated by reference.

The air permeable material 44 is preferably, positively secured in the recesses 58 of the base material with adhesive or the like and is of a thickness such that the top surface of the air permeable material is coplanar with the top surface 62 of the bridge sections 60 in the base material. Accordingly, the cross-section of the air permeable material corresponds with the cross-section of the recesses in the base material.

The ridge cap 46 which is of inverted v-shaped cross-section corresponding to the cross-sectional configuration of the interconnected roof sections is rigid and adapted to overlie the strips 40 of material which have been placed on and secured to the underlying roof sections 18 and due to the continuous height of the strip material, the ridge cap is positioned in continuous engagement with the strip material. The ridge cap can be secured in position with fasteners 64 (FIG. 6), passed through the ridge cap, the bridge section of the base material, and into the upstanding projections or ridges 34 and 36 of the channel members forming the covering 30 or outer surface of the roof sections.

It will therefore be appreciated with the ridge cap 46 secured to the roof sections and the strip material sealing the space therebetween that an air permeable connection is established between the ridge cap and the underlying roof sections through which air can easily pass but through which rain, insects or other such undesirable materials are inhibited from passing. Further, the strip is sealed to the underlying roof section 18 to prohibit the ingress of rain, insects, and the like between the two materials.

It should also be appreciated from the above description that the system of the present invention can be easily installed by one individual who can first apply the elongated strips 40 of material to the underlying roof sections 18, with the strips of material remaining in place due to the adhesive 52 or other suitable connective material on the strips. Once the strips have been properly positioned, the ridge cap 46 is easily laid over the strips on opposite sides of the slot 22 in the ridge 20 of the roof structure and secured to the underlying roof sections 18 through the strip material with the fasteners 64.

Although the present invention has been described with a certain degree of particularity, it is understood that the present disclosure has been made by way of example, and changes in detail or structure may be made without departing from the spirit of the invention as defined in the appended claims.

What is claimed is:

1. A roofing system component configured to permit the egress of air from a building structure but inhibit the ingress of moisture or insects, the component comprising:

a strip of two materials comprising:

one material defining a plurality of recesses, each recess completely separated from another recess by a section of the one material, the recesses extending across the entire width of the strip; and a plurality of discontinuous sections of a second material, each section seated in one of the plurality of recesses, and the second material being air permeable, the strip having a first side opposite a second side wherein one of the first side or the second side has a planar surface when the strip is in use and the other of the first side or the second side is configured to engage an uneven roof surface.

2. The roofing system component of claim 1, wherein the one material is a flexible, liquid impermeable material.

3. The roofing system component of claim 1, wherein the second material at least partially fills the plurality of recesses.

4. The roofing system component of claim 1, wherein one of the one material or the second material is configured to at least partially mate with a section of an underlying roof section.

5. The roofing system component of claim 1, wherein the one material is a cross linked polyethylene foam having a two pound density.

6. The roofing system component of claim 1, wherein the second material is a non-woven, non-wicking, fiber-based matting material.

7. A roofing system component configured to permit the egress of air from a building structure but inhibit the ingress of moisture or insects, the component comprising:

a composite strip of two interconnected materials comprising:

one material forming a base of the strip and defining a plurality of recesses, each recess completely separated from another recess by a portion of the one material and the recesses extending across the full width of the strip and the recesses having a substantially rectangular cross-section; and a second material defining a plurality of discontinuous sections, each section received in one of the plurality of recesses defined in the one material, the strip having a first side opposite a second side wherein one of the first side or the second side has a planar surface when the strip is in use and the other of the first side or the second side is configured to engage an uneven roof surface.

8. The roofing system component of claim 7, wherein the second material is air permeable.

9. The roofing system component of claim 7, wherein the one material is a flexible, water impermeable material.

10. The roofing system component of claim 7, wherein the second material at least partially fills the plurality of recesses.

11. The roofing system component of claim 7, wherein one of the one material or the second material is configured to at least partially mate with a roof section.

12. The roofing system component of claim 7, wherein the one material is a cross linked polyethylene foam having a two pound density.

13. The roofing system component of claim 7, wherein the second material is a non-woven, non-wicking, fiber-based matting material.

14. A roofing system component configured to permit the egress of air from a building structure but inhibit the ingress of moisture or insects, the component comprising:

a composite strip comprising:

a base defining a plurality of recesses along a length of the strip, each recess separated from another recess by a section of the base and each recess extending across a full width of the strip; and a plurality of discontinuous sections of an air permeable material, each section received in one of the plurality of recesses defined in the base, the strip having a first side opposite a second side wherein one of the first side or the second side has a planar surface when the strip is in use and the other of the first side or the second side is configured to engage an uneven roof surface.

15. The roofing system component of claim 14, wherein the air permeable material at least partially fills the plurality of recesses.

16. The roofing system component of claim 14, wherein one of the base or the air permeable material is configured to at least partially mate with a roof section.

17. The roofing system component of claim 14, wherein the base is a cross linked polyethylene foam having a two pound density.

18. The roofing system component of claim 14, wherein the air permeable material is a non-woven, non-wicking, fiber-based matting material.

19. The roofing system component of claim 14, wherein the base is a flexible, water impermeable material.

20. The roofing system component of claim 14, wherein the section of the base material extends continuously from a top surface of the base to a bottom surface of the base.

* * * * *